US009457363B2

(12) United States Patent
Duffin et al.

(10) Patent No.: US 9,457,363 B2
(45) Date of Patent: Oct. 4, 2016

(54) NUTATING SPRINKLER HEAD

(71) Applicants: Don Duffin, Paul, ID (US); Roger Duffin, Paul, ID (US)

(72) Inventors: Don Duffin, Paul, ID (US); Roger Duffin, Paul, ID (US)

( * ) Notice: Subject to any disclaimer, the term of this patent is extended or adjusted under 35 U.S.C. 154(b) by 24 days.

(21) Appl. No.: 14/195,652

(22) Filed: Mar. 3, 2014

(65) Prior Publication Data

US 2014/0312143 A1 Oct. 23, 2014

Related U.S. Application Data

(60) Provisional application No. 61/771,488, filed on Mar. 1, 2013.

(51) Int. Cl.
*B05B 3/00* (2006.01)

(52) U.S. Cl.
CPC ..... *B05B 3/008* (2013.01)

(58) Field of Classification Search
CPC ..... B05B 3/008
USPC ..... 239/233, 461, 222.17, 222.11, 600, 239/222.13, 222.15, 222.19, 222.21
See application file for complete search history.

(56) References Cited

U.S. PATENT DOCUMENTS 7,273,189 B2 * 9/2007 Ide ..... B65D 61/00 169/37
2010/0252654 A1 * 10/2010 Sesser ..... B05B 3/0486 239/222.17

* cited by examiner

*Primary Examiner* — Len Tran
*Assistant Examiner* — Tuongminh Pham
(74) *Attorney, Agent, or Firm* — Robert L. Shaver; Shaver & Swanson, LLP

(57) ABSTRACT

A sprinkler head with a nutating water distribution cage attached to a sprinkler body. Water from the sprinkler head impacts a strike plate of the cage to initiate nutation of the cage. Spiral grooves on the strike plate contribute to the nutation of the cage, and an upturned edge on the periphery of the strike plate contributes to the spread and uniform distribution of water from the sprinkler head.

10 Claims, 2 Drawing Sheets

NUTATING SPRINKLER HEAD

PRIORITY/CROSS-REFERENCE TO RELATED APPLICATIONS

This application claims the benefit of U.S. Provisional Application No. 61/771,488, filed Mar. 1, 2013, the disclosure of which is incorporated by reference.

TECHNICAL FIELD

The herein disclosed and claimed inventive concepts generally relates to a sprinkler head, and more particularly to a nutating sprinkler head for randomizing water distribution.

BACKGROUND

Irrigation systems such as center pivot systems have a structure from which down tube are suspended, with sprinkler heads attached to the down tubes. The sprinkler heads take a number of different forms and all try to create a uniform and random spread of water droplets, or a size which does not result in excessive evaporation. The sprinkling heads may also be mounted on top of the rotating structures of the center pivot systems, or on upward turned ends of the down tubes. Such sprinkler heads can operate in any orientation, because the force of the water stream is greater than the force of gravity on the lightweight sprinkler parts. However, for convenience the sprinkler head and its parts are described as being in the orientation as shown in the figures, with "upper", "lower", "top", and "bottom" surfaces applied to the sprinkler parts in the orientation shown in the figures.

A large and uniform spray of water is preferable, so that the areas watered by a particular sprinkler head overlap with neighboring sprinkler head, and the ground under the sprinklers is uniformly covered.

SUMMARY OF THE DISCLOSURE

Figure 1:
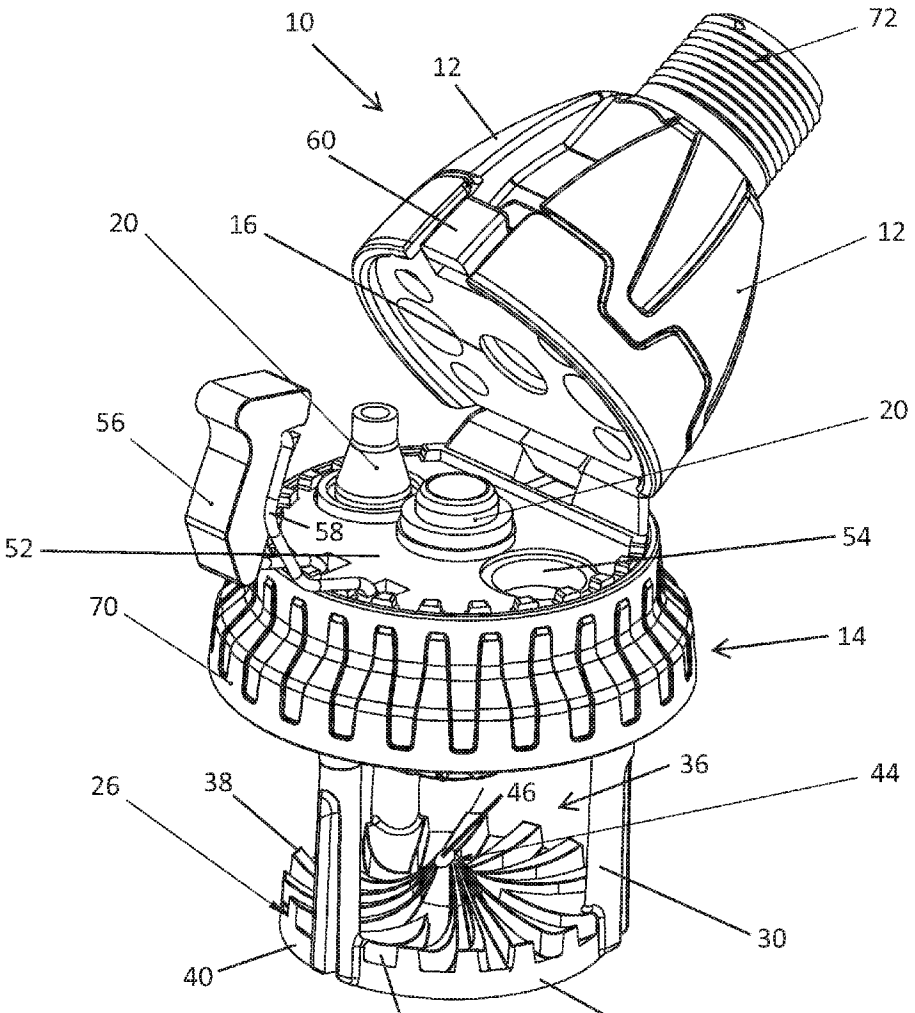
FIG. 1 is a perspective view of the sprinkler head, with the top half opened to reveal the inner deck.

Disclosed is a water distributing sprinkler head, which is made up of a sprinkler body which partially encloses a water delivery tube with an attached water nozzle. Water flows through the sprinkler body and exits out the water nozzle, which constricts the water stream to form the water stream into a more narrow stream of water. The sprinkler body includes a sprinkler body upper plate, and a sprinkler lower plate. Each of these are generally ring shaped, and have a passage for the stream of water or the water delivery tube to pass through. Each of the sprinkler body plates have a first side and a second side, which correspond to an upper side, and a lower side, as the sprinkler head is shown in the figures. The sprinkler body upper and lower plates are fixedly attached to the sprinkler body.

The sprinkler head also includes a water distribution cage. The water distribution cage is made up of a lower cage plate with a first and second side, and an upper cage plate with a first and second side. The upper and lower cage plates can also be called the swash plate, and the strike plate. The two cage plates are coplanar and held in a spaced apart relationship by one or more cage arms. The upper cage plate is trapped between the sprinkler body upper and lower plates, and there is sufficient room between the sprinkler body upper and lower plates for the upper cage plate to rock back and forth, as well as to rotate around the stationary sprinkler body plates.

The upper cage plate defines a passage for the water delivery tube lower end, and also has a pair of raised projections adjacent to the water passage. The projections are positioned opposite each other on a second (bottom) side of the upper cage plate (swash plate), and rest on the first (upper) surface of the sprinkler body lower plate. The projections serve to destabilize the water distributing cage, and to initiate a motion of the water distributing cage to rotate and tilt simultaneously, in a manner similar to a coin which is placed on its side and spun. The motion is called nutation, and at the end of the coin's spinning, it is rotating slowly, while rocking side to side, or nutating.

The water distribution cage has a generally circular lower cage plate first (top) side which has a generally peaked or pointed surface profile, preferably with an upturned edge at the periphery of the plate. This plate can be called the strike plate. The surface is incised by spirally radiating grooves which radiate from a central raised point in the center. The raised point in the center of the plate has a beveled top surface. This is so that when it is first struck by a stream of water, and water will deflect the plate to one side, a motion caused by the bevel. Once the strike plate is deflected to one side by the initial impact of water, the water stream then strikes the radiating groove on the strike plate, which initiates the spiral motion. The projections on the upper cage plate facilitate this initiation of motion, by keeping the cage from stabilizing when struck by the water stream.

The water distribution cage thus hangs freely from the pair of raised projections when said cage is without water and said sprinkler head is in a vertical position, with the bevel on the lower plate provided for deflecting the strike plate by an initial jet of water from the water directing tube. These structures plus the spirally radiating grooves serve to initiate a nutating motion in said water distribution cage after the initial deflection by the force of water.

Another feature of the sprinkler head are first and second resilient cushions. These can be rubber or rubber like material affixed or attached to the surfaces of the sprinkler body upper plate second (lower) edge and the sprinkler body lower plate first (top) plate. The resilient cushions are placed on these structure to interact with the first and second sides of the cage upper plate. The cushions serve to increase the friction between sprinkler body plates and the cage upper plate, to the cage upper plate nutates rather than spin on the sprinkler body. They also provide a dampening effect and reduction of wear between said sprinkler body plates and the upper cage plate surfaces.

The sprinkler head body described above can optionally include a top half and a bottom half, with the two joined by a hinged, and closed with a clamp or clasp. One feature of the clam shell configuration described above would be the inclusion of storage positions or slots for additional water nozzles, for replacement parts or to give the spread of water a different pattern with a different sprinkler nozzle.

The sprinkler head can have as an option a weight, with the purpose of the weight being to dampen the vibrations caused nutation and help prevent wind from blowing the sprinklers away from vertical when they are hung over the crop on rubber hose.

The sprinkler head can also include channels for collecting water flows from the outside of the sprinkler head, and directing the water collected into the flow of water through the water delivery tube. This has the effect of eliminating a drip from the sprinkler head, and having all water possible be send to impact the strike plate, and to be spread in a pattern determined by the surface and shapes of the strike plate.

DETAILED DESCRIPTION OF THE EXEMPLARY EMBODIMENTS

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Figure 2:
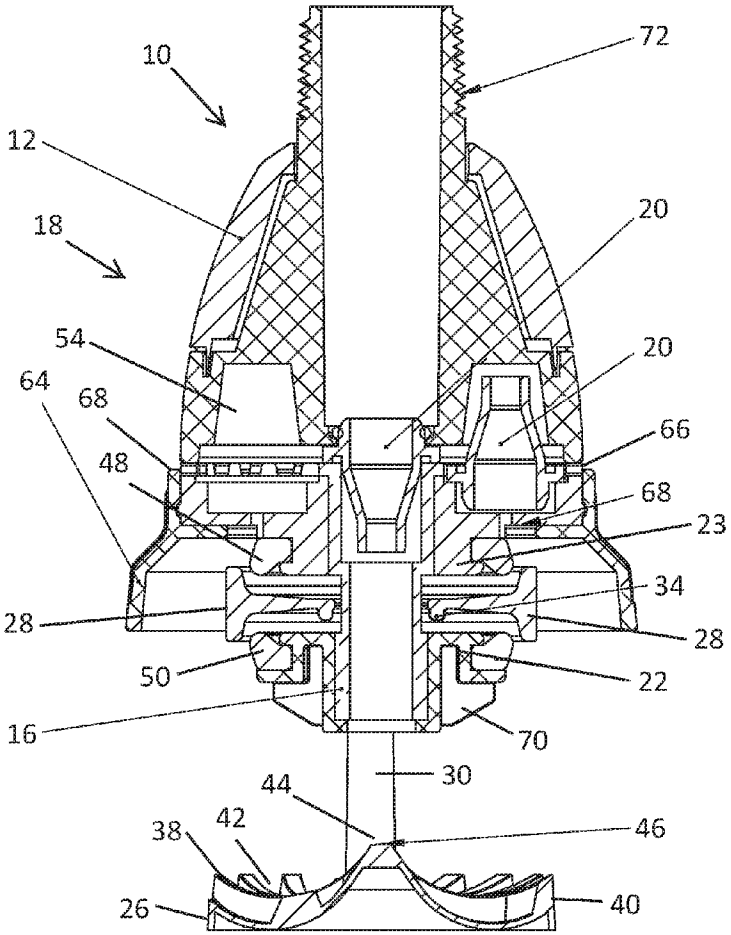
FIG. 2 is a cross sectional view of the sprinkler head through the center of the sprinkler head.

A preferred embodiment of the disclosed technology is shown FIGS. 1 and 2. FIG. 1 show the disclosed sprinkler head 10, in what we will call a vertical orientation. The sprinkler head can operate in an inverted orientation, but the orientation shown in the figures will be termed vertical, as regards parts with a "top" side or a "bottom" side.

The sprinkler head 10 includes a clamshell top half 12, and a clamshell bottom half 14. The sprinkler head could be made as one unit, without the parts that allow it to open, but what is described here is a preferred embodiment, not THE preferred embodiment and not all possible embodiments. The embodiment shown in FIG. 1 includes a cam action closure 56, which has a wire loop 58 and a locking lip 60 over which the wire loop is secured.

Extending through both clamshell halves is a water delivery tube 16. Inserted in the water delivery tube is a water nozzle 20, which is shaped like a funnel to force the water into a more narrow stream, for more velocity and force when it hits the strike plate, and for more distance that the water is thrown from the sprinkler head. An inner deck 52 is exposed when the sprinkler body 18 is opened, and in the inner deck 52 is one or more storage positions 54, where extra nozzles 20 can be stored. Part of the storage positions is in the inner deck and part is in the bottom surface of the clamshell top half 12.

Shown in FIG. 1 is a water distribution cage 24, which has an upper cage plate 28 (swash plate) and a lower cage plate 26 (strike plate). Each of the cage plates has an upper or first surface, and a lower or second surface. The upper and lower cage plates are connected to each other and held in a spaced apart relationship by one or more cage arms 30. The strike plate 26 includes a number of spirally radiating grooves 42. The strike plate 26 also has an upturned edge 38 around the periphery 40 of the plate 26. At the center of the plate 26 is a peak 44 which in at the center of the peaked surface profile 36. The peak 44 has a planar facet top surface 46, which is positioned to cause the cage 24 deflect to one side when first struck by a stream of water. The planar facet is aligned perpendicular to the raised projections 34 on the underside of the swash plate (upper cage plate).

Shown in FIG. 2 are the same parts as shown in FIG. 1, with some internal parts and relationships more clearly shown. The sprinkler body 18 includes a lower sprinkler body plate 22, and an upper sprinkler body plate 23. These plates are on either side of the upper cage plate 28. The upper cage plate 28 has at least one raised projection 34 which destabilize the cage plate 28 and help initiate the nutating motion of the cage when water is flowing through the sprinkler head. Also visible in FIG. 2 are a first resilient cushion 48 and a second resilient cushion 50. These form the lip of the sprinkler body plates 22 and 23 in this particular embodiment, and contact the upper and lower rim or sides of the upper cage plate 28 (the swash plate). Shown in FIG. 2 is a skirt 64. Also shown is a water catch lip 66, which captures water flowing down the outside of the sprinkler body 18, and returns the water to the main water flow via scavenge channels 68. Channels will deliver collected water to the top side of the swash plate where it drops to the nutating impact plate and is mixed with carried away with the discharge water.

Shown in FIG. 2 is a weight 70. The weight is necessary to dampen the vibrations caused nutation and help prevent wind from blowing the sprinklers away from vertical when they are hung over the crop on rubber hose. Water enters the water delivery tube via an input nozzle 72.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

The invention claimed is:

1. A water distributing sprinkler head, comprising, a water delivery tube with an attached water nozzle;

a sprinkler body partially enclosing said water delivery tube and nozzle;

a sprinkler body upper plate attached to a lower end of said water delivery tube;

a sprinkler body lower plate attached to a lower end of said water delivery tube;

a water distribution cage attached to said water delivery tube lower end, said water distribution cage with a lower cage plate with a first and second side, and an upper cage plate with a first and second side, with said cage plates held in a spaced apart relationship by one or more cage arms;

with said upper cage plate defining a passage for said water delivery tube lower end, and also having a pair of raised projections adjacent said passage for said water delivery tube, with said projections positioned opposite each other on a second side of said upper cage plate;

said lower cage plate first side having a generally peaked surface, said surface incised by spirally radiating grooves with a peak on said lower plate first side centrally positioned and having a planar facet on said peak; wherein said water distribution cage is configured to hang freely from said pair of raised projections when said cage is without water and said sprinkler head is in a vertical position, with said planar facet on said lower plate configured for deflection by an initial jet of water from said water directing tube, to initiate a nutating motion in said cage after said initial deflection with said nutating motion maintained by a force of water on said spirally radiating grooves.

2. The sprinkler head of claim 1 in which said first surface of said lower cage plate further comprises a profile with an upturned edge at the periphery of said plate.

3. The sprinkler head of claim 1 which further comprises a first resilient cushion on an upper surface of said sprinkler body lower plate, and a second resilient cushion attached to said sprinkler body upper plate, with said cushions spaced apart from said first cushion, with said upper cage plate positioned between said first and second cushion, with said cushions for providing a dampening effect and reduction of wear between said sprinkler body plates and said first cushion and said upper cage plate first side, and to provide sufficient friction between upper cage plate and cushion to prevent slipping:

with said cage configured to contact said first and said second cushion during rotation of said cage.

4. The sprinkler head of claim 1 in which said sprinkler body is comprised of a first half and a second half, with said halves removable from each other.

5. The sprinkler head of claim 4 in which said halves are hinged to each other and open by rotations around a hinge.

6. The sprinkler head of claim 5 which further comprises a removable flow directing nozzle positioned in one of said sprinkler body halves.

7. The sprinkler head of claim 6 which further comprises one or more storage positions for alternate flow directing nozzles.

8. The sprinkler head of claim 1 which further comprises additional weight in said sprinkler body.

9. The sprinkler head of claim 1 which further comprises channels for water collection from water on an exterior of the sprinkler, with at least one pathway for water return to the main flow of water.

10. The sprinkler head of claim 1 which further comprises channels for water collection from water on an exterior of the sprinkler, with at least one pathway for water return to the main flow of water.

* * * * *